US006041525A

United States Patent [19]

Kelley

[11] Patent Number: 6,041,525

[45] Date of Patent: Mar. 28, 2000

[54] FOOTWEAR GRINDING APPARATUS WITH FLANKING BEARING SURFACES

[75] Inventor: Benjamin B. Kelley, Redondo Beach, Calif.

[73] Assignee: Artemis Innovations Inc., Lomita, Calif.

[21] Appl. No.: 09/132,827

[22] Filed: Aug. 12, 1998

[51] Int. Cl.[7] ..... A43B 5/00

[52] U.S. Cl. ..... 36/115; 36/107; 36/72 A

[58] Field of Search ..... 36/115, 107, 108, 36/113, 72 A, 73, 25 R, 152, 167, 132

[56] References Cited

U.S. PATENT DOCUMENTS

| | | | |
|---|---|---|---|
| 234,030 | 11/1880 | Hadley et al. . | |
| 579,577 | 3/1897 | Hanscom | 36/72 A |
| 702,476 | 6/1902 | Price . | |
| 875,560 | 12/1907 | Vaughn . | |
| 881,079 | 3/1908 | Jolitz . | |
| 892,152 | 6/1908 | Harman . | |
| 1,056,091 | 3/1913 | Dickson . | |
| 1,189,329 | 7/1916 | Winagle . | |
| 1,428,232 | 9/1922 | Holmen . | |
| 1,592,692 | 7/1926 | Hackett . | |
| 1,636,909 | 7/1927 | Haney . | |
| 1,637,897 | 8/1927 | Eddins . | |
| 1,984,989 | 12/1934 | Reed . | |
| 2,060,391 | 1/1936 | Castagnola . | |
| 2,476,806 | 7/1949 | Brandt, Jr. . | |
| 2,484,935 | 10/1949 | De Rooy . | |
| 3,058,240 | 10/1962 | Osgood . | |
| 3,486,250 | 12/1969 | Purtle . | |
| 4,691,453 | 9/1987 | Tifre . | |
| 5,249,376 | 10/1993 | Capria . | |
| 5,319,866 | 6/1994 | Foley et al. | 36/91 |
| 5,388,350 | 2/1995 | Parker, Jr. . | |
| 5,398,970 | 3/1995 | Tucky | 36/115 |
| 5,410,821 | 5/1995 | Hilgendorf . | |
| 5,425,186 | 6/1995 | Hoyt | 36/97 |
| 5,632,104 | 5/1997 | Zohar | 36/25 R |
| 5,638,614 | 6/1997 | Hardy . | |
| 5,716,723 | 2/1998 | Van Cleef et al. | 36/25 R |

FOREIGN PATENT DOCUMENTS

| | | | |
|---|---|---|---|
| 362752 | 12/1931 | United Kingdom | 36/72 A |
| PCT/US97/11652 | 7/1997 | WIPO . | |

*Primary Examiner*—M. D. Patterson

*Attorney, Agent, or Firm*—Fulwider Patton Lee & Utecht, LLP

[57] ABSTRACT

A grinding plate formed on its bottom side with a transverse downwardly facing grind surface disposed medially under the arch and configured on the medial side with a longitudinal medial runner having one radius of curvature and formed on the lateral side with a longitudinally extending runner having a downwardly and outwardly curved surface of a greater radius of curvature. In one aspect, the bearing surface is bifurcated centrally by longitudinal extending groove to form flanking bearing surface segments.

34 Claims, 5 Drawing Sheets

FIG. 5
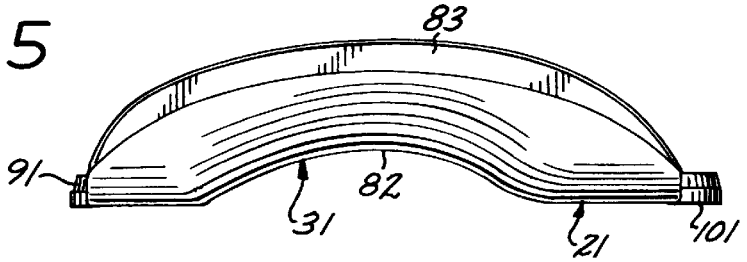
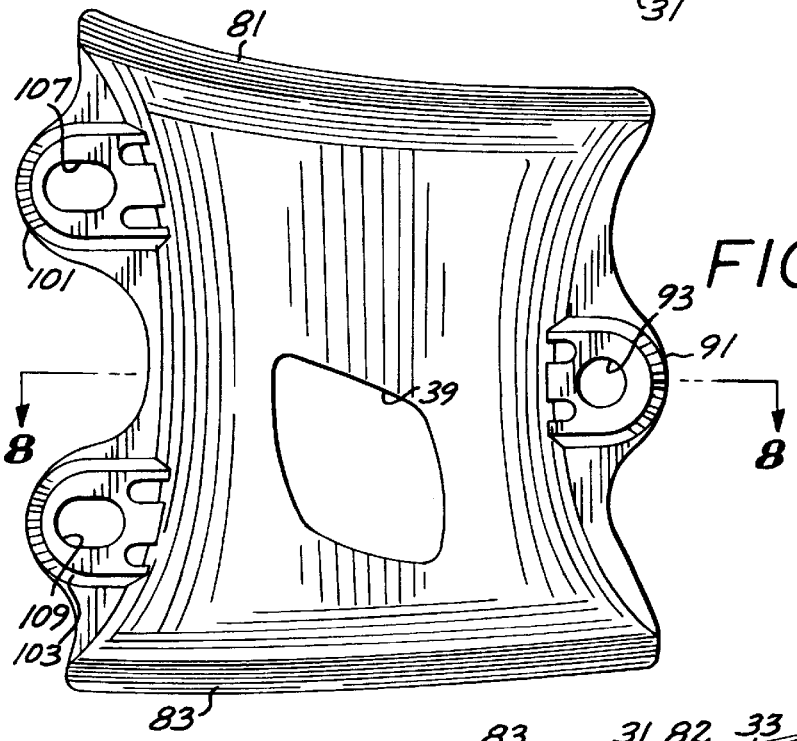
FIG. 6
FIG. 7
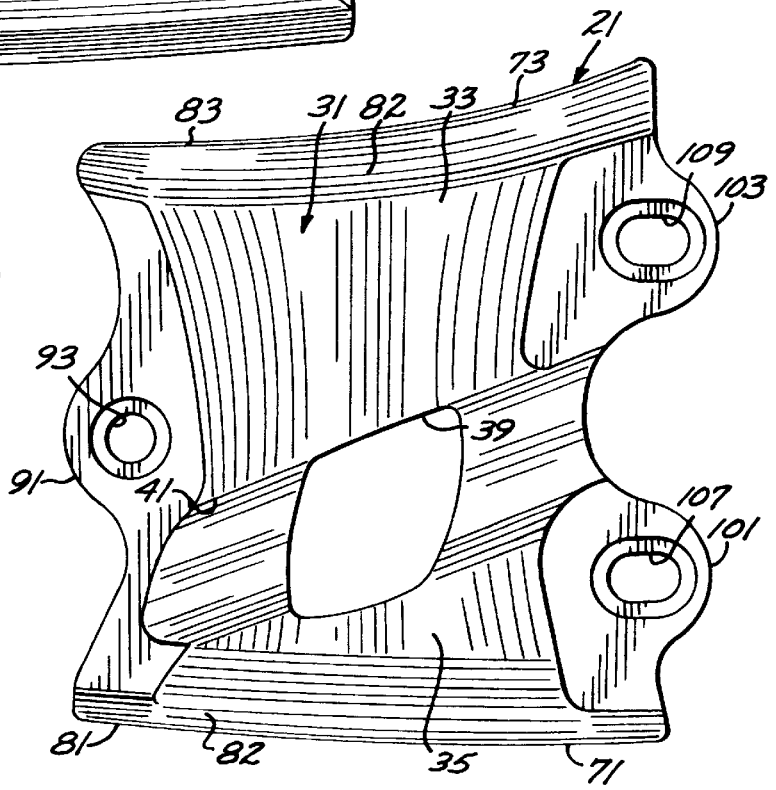

FOOTWEAR GRINDING APPARATUS WITH FLANKING BEARING SURFACES

BACKGROUND OF THE INVENTION

1. Field of the Invention

The present invention relates generally to footwear and more particularly to athletic footwear including a hard grind plate embedded in a shoe for riding longitudinally along rails, pipes and the like.

2. Description of the Prior Art

Athletic footwear has gained immense popularity in the United States and throughout the world to be worn during exercise activities. Athletic footwear is known incorporating hard soles often used in bowling activity and to mount cleats used in baseball or softball athletic contests. Other athletics prefer shoes with cushioned soles such as in the case tennis shoes or basketball shoes.

Other athletic or entertainment activity which has gained immense popularity in recent years is skateboarding and in-line roller skating. Highly athletic youthful participants have developed a maneuver commonly referred to as grinding wherein the athlete will jump into the air while riding a skateboard or wearing a pair of in-line skates and slide the undercarriage along an elongated track defined by, for instance, a hand rail, park bench back or curb edge. This activity is referred to in the sport as "grinding".

Grinding shoes have been proposed which incorporate a hard plate in the arch area or other strategic location on the sole of the shoe with a downwardly opening cylindrical trough so the wearer can wear the shoe in a normal manner and, when the opportunity presents itself for a grinding activity, he or she can run toward a rail, curb or the like and leap upwardly mounting the sliding surface with the hard plate to be centered in said trough to slide therealong. This activity has gained great popularity in the field and is currently enjoyed by many youngsters utilizing shoes marketed under the trademark SOAP by the assignee of the present application. Such shoes incorporate grind plates of the type disclosed in U.S. patent application Ser. No. 08/890,595 filed Jun. 9, 1997, U.S. patent application Ser. No. 08/799,062, filed Feb. 10, 1997, claiming priority of Provisional Application Ser. No. 60/022,318, filed Jul. 23, 1996 all assigned to the assignee of the present application, such applications now having been granted U.S. Patent Nos. 6,006,451 and 5,970,631.

Grind plates incorporated in the SOAP shoes are typically constructed with a saddle configuration to provide a downwardly open semi-cylindrical trough having a transverse upper extent projecting horizontally throughout a majority of the shoe width to serve as a low friction bearing surface for sliding along the underlying rail, curb or the like. Such devices, while having enjoyed significant commercial success, suffer two major shortcomings. First, the substantially horizontally projecting upward extent of the trough does not truly reflect the ideal surface curvature in the lateral direction for accommodating the variations in angular orientations of the shoe necessary to accommodate the ideal foot manipulations necessary to allow for the wearer to exercise the maneuvers preferred by a high percentage of the participating athletes. I have discovered that, while each athlete may have his or her own preferred unique grinding exercises or characteristics, the majority of the grinding population tend to, in a typical grinding maneuver, manipulate the foot through a predictable range, as an example, because of the human anatomy and balance necessary for a successful and enjoyable maneuver, the bearing surface of the grind plate must typically accommodate a more gradual laterally outward rolling action than is necessary for rolling the shoe over in the medial direction. Thus, their exists a need for a grinding plate which while providing a stable flat support when the shoe is erect but which will allow for a rolling action when angled in either transverse direction and will provide a relatively free rolling action in the lateral direction.

Another shortcoming addressed by the plate of the present invention is the fact that the prior plates are themselves somewhat heavy, particularly when incorporated in shoes worn throughout the day on successive days by youngsters involved in the numerous high energy activities typically associated with youth. Thus, there exists a need for a grind plate having a relatively light weight structure configured with downwardly facing grind surfaces only in the strategical locations necessary to support expected grinding maneuvers executed by the wearers.

These and other features and advantages of the present invention will become apparent from the following detailed description of a preferred embodiment which, taken in conjunction with the accompanying drawings, which illustrate by way of examples features of the invention.

BRIEF DESCRIPTION OF THE DRAWINGS

FIG. 5 is a right side view of the grinding plate shown in FIG. 1;

FIG. 6 is a top plan view, in enlarged scale, of the plate shown in FIG. 1;

FIG. 7 is a bottom plan view, in enlarged scale, of the plate shown in FIG. 1;

DETAILED DESCRIPTION OF THE PREFERRED EMBODIMENTS

Figure 1:
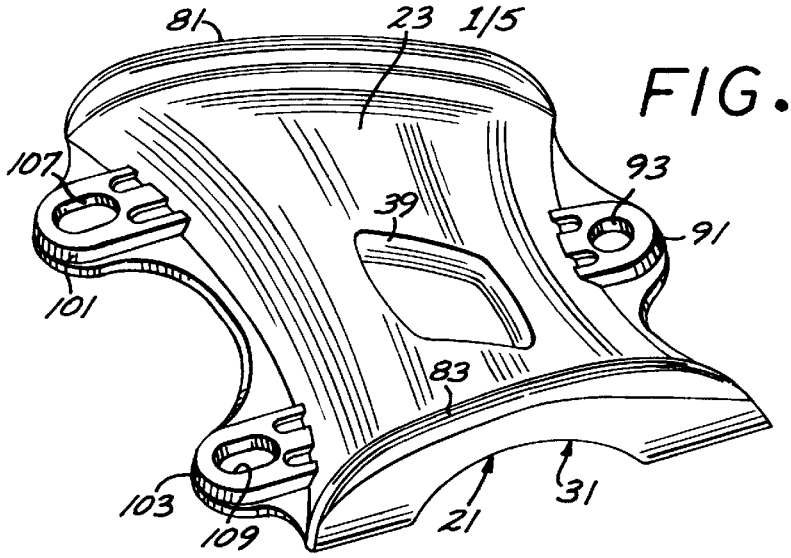
FIG. 1 is a top perspective view of a grinding plate embodying the present invention.
Figure 2:
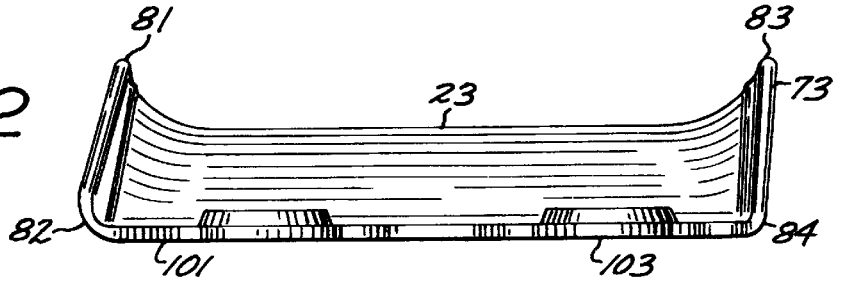
FIG. 2 is a front view, in enlarged scale, of the plate shown in FIG. 1.
Figure 3:
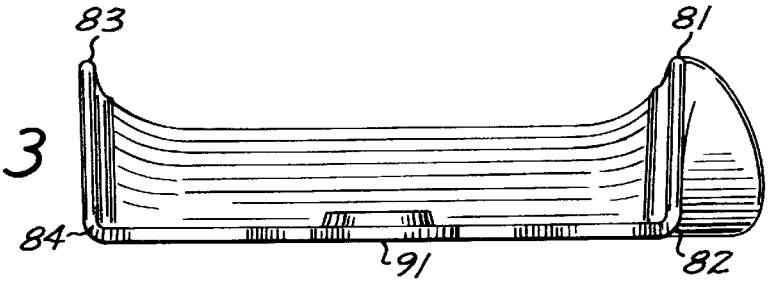
FIG. 3 is a back view, in enlarged scale, of the plate shown in FIG. 1.
Figure 4:
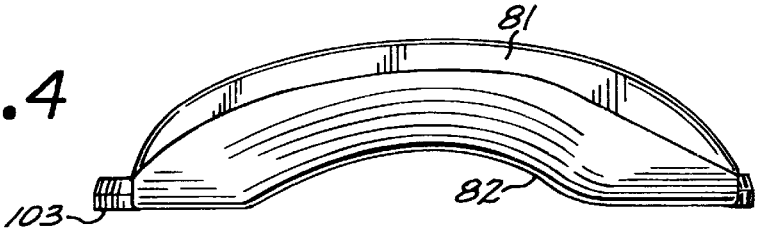
FIG. 4 is a left side view, in enlarged scale, of the plate shown in FIG. 1.
Figure 8:
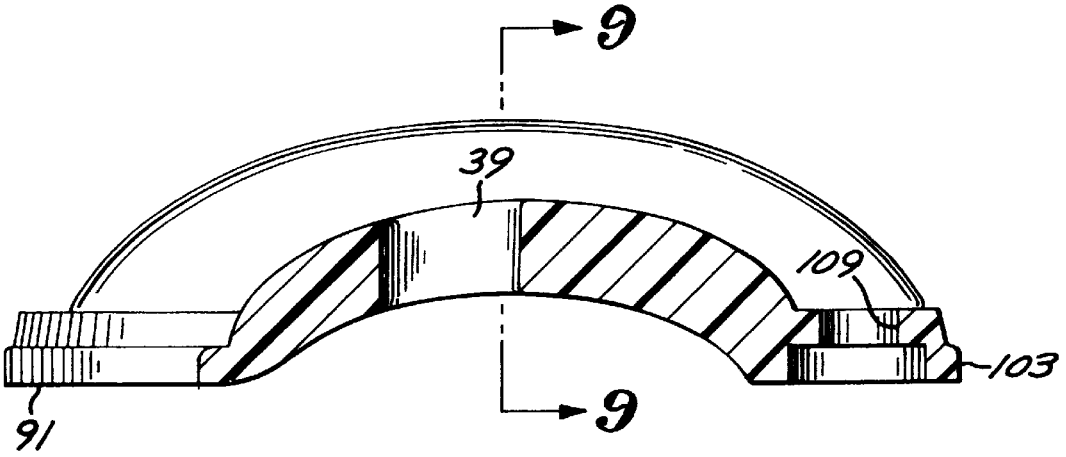
FIG. 8 is a longitudinal sectional view, in enlarged scale, taken along the lines 8—8 of FIG. 6.
Figure 9:
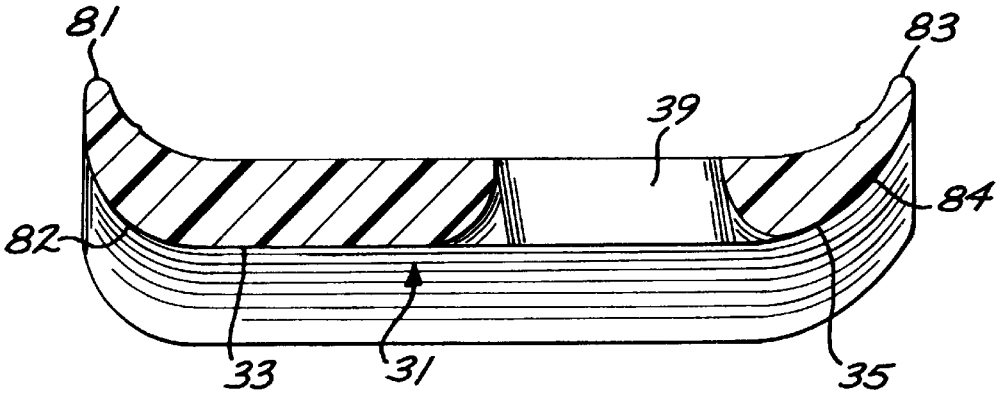
FIG. 9 is a transverse sectional view, taken along the line 9—9 of FIG. 8.
Figure 10:
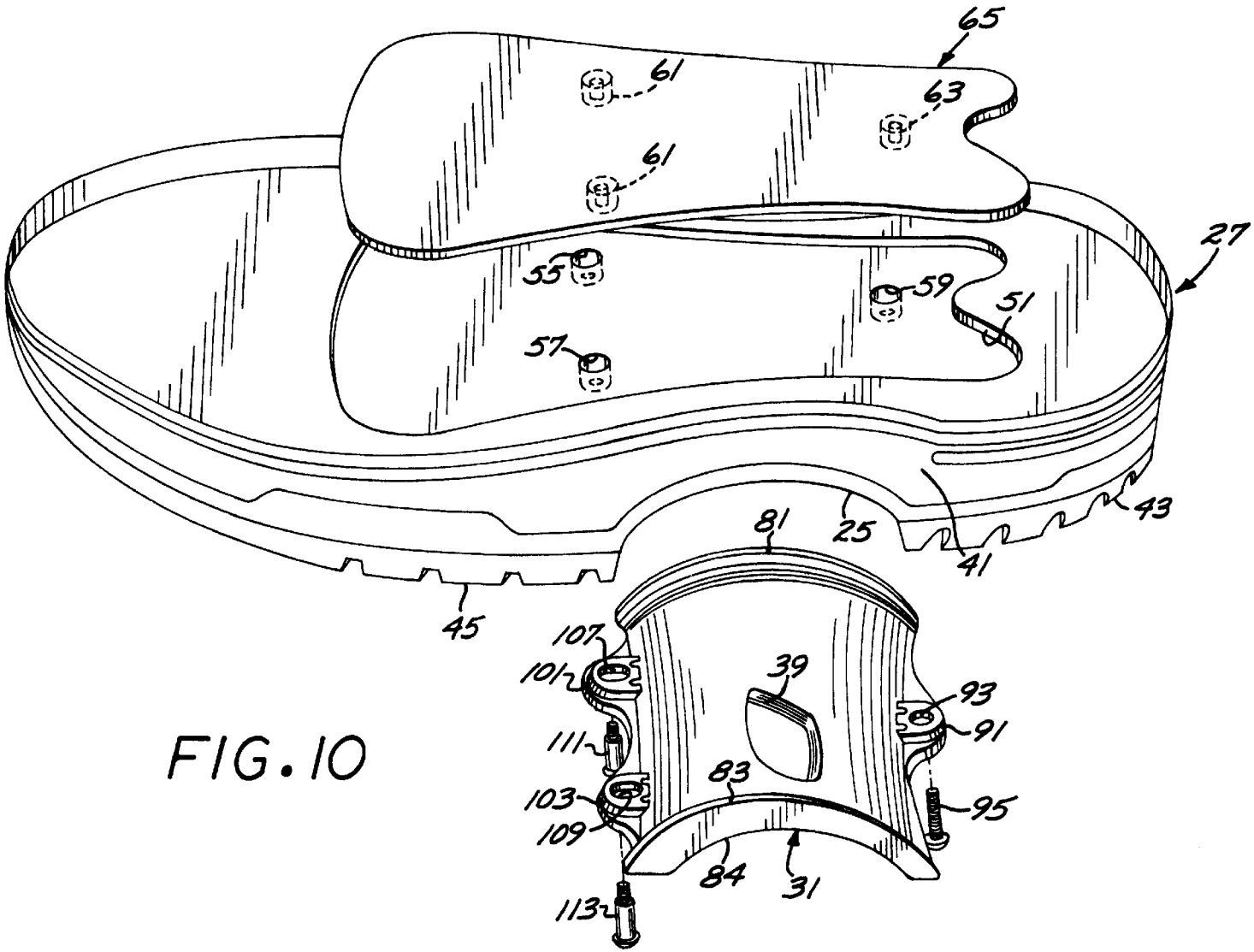
FIG. 10 is a perspective view, in reduced scale, showing the grinding plate of FIG. I in exploded view to be mounted on the underside of shoe sole.
Figure 11:
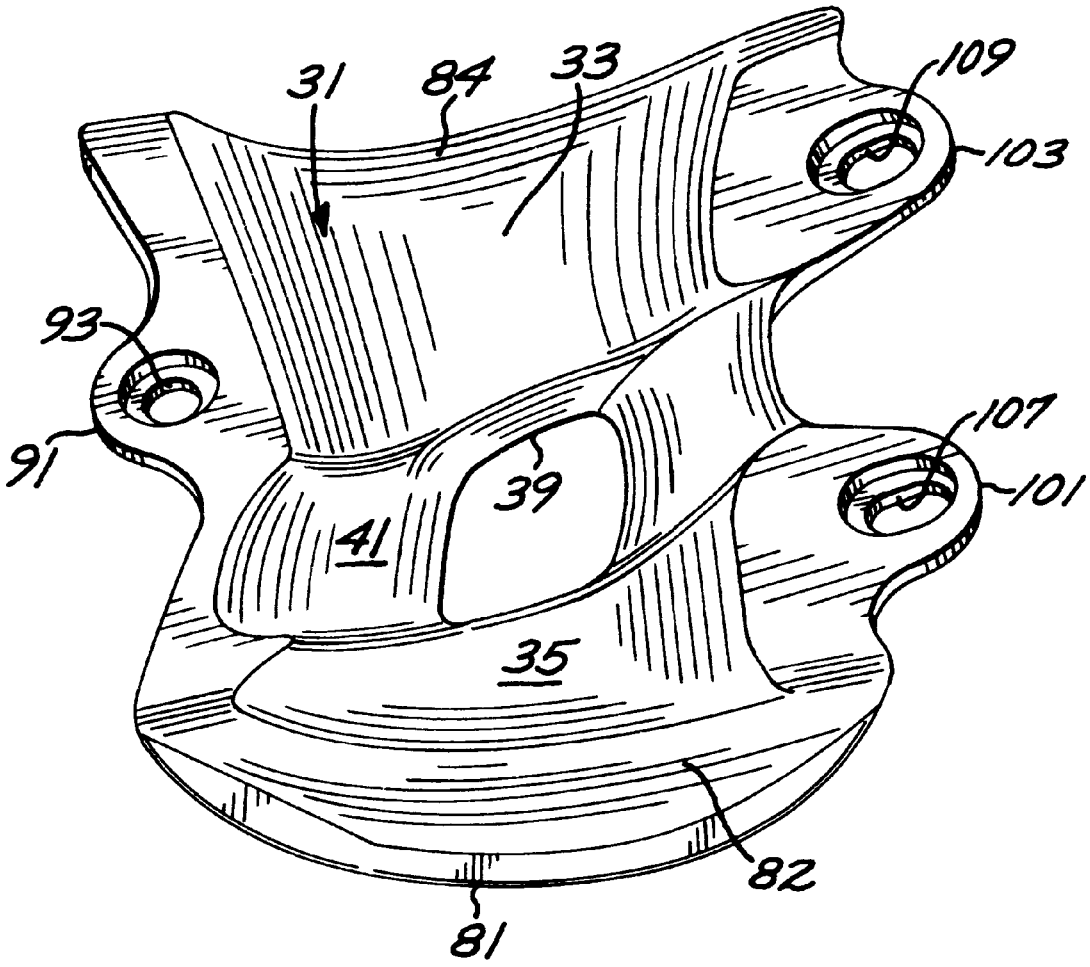
FIG. 11 is a bottom perspective view of the grinding plate shown in FIG. 1.

Referring to FIGS. 1, 7 and 10, the grinding plate of the present invention includes, generally, a somewhat saddle shaped grind plate body 21 with an upwardly arched top side 23 for nesting in a cylindrically shaped concavity 25 formed in the sole 27 of a shoe. The bottom side of the saddle shaped grinding plate body 21 is formed with a downwardly facing arcuate trough 31 which is configured at its upper extent with a transverse bearing axis projecting generally horizontally in the medial portion (FIG. 9) and then curves transversely outwardly and upwardly at the medial side to form a relatively small radius of curvature longitudinally extending downwardly and outwardly facing medial runner 82 and formed at the lateral side to curve upwardly and outwardly to form a large radius of curvature downwardly and outwardly facing lateral runner 84. In the preferred embodiment the trough 31 is formed by a pair of flanking cylindrical plate sectors defining medial and lateral concave bearing surfaces 33 and 35 spaced on opposite sides of a centrally located diagonal groove 41. Also included in the preferred embodiment is a parallelogramatic shaped hole 39 formed between the medial and lateral bearing surfaces 33 and 35 (FIG. 7).

It will be appreciated by those skilled in the art that the grinding plate body 21 may take numerous different configurations and may attach to various different locations on the sole of a shoe. In the preferred embodiment, it is embedded in the sole 27 which is configured with a central cushion 41 surmounted on a heel 43 and forefoot outersole 45 each of which is formed with downwardly facing high friction tread as shown in FIG. 10. The midsole 27 is configured on its top side with a formed depression 51 and has through fastener fitting bores 55 and 57 arranged in an triangular shaped pattern for receipt of respective barrels 61 and 63 depending from a support shank generally designated 65 configured to complimentarily fit recess 51. The construction and performance of the shank 65 is set forth in greater detail in U.S. patent application Ser. No. 08/890,595 filed Jul. 9, 1997, and now U.S. Pat. No. 6,006,451, which application is incorporated herein by reference.

Referring to FIGS. 1, 6 and 10, the grinding plate body 21 is generally in the form of a sector of a cylinder and is configured to be complementally received in the cylindrically shaped concavity 25 in the midsole 27 (FIG. 10). The grinding plate body 21 is formed in top plan view with a generally longitudinally extending lateral edge 71 (FIG. 7) and a medial edge 73 which angles rearwardly and outwardly relative to the edge 71 to compliment the shape of the medial side of the midsole 27. The medial side 73 is formed with an upwardly raised medial flange 81 which angles rearwardly and inwardly to compliment the shape of the medial side of the shoe sole 27 and cooperate with the upper surface of the grind plate body 21 to provide enhanced support for the sole 27 during maneuvers by the wearer. The lateral side of the grind plate body 21 is formed with an upwardly raised longitudinally extending flange 83 which is complementally shaped to accommodate the lateral side of the shoe sole 27 in the arch area. The plate is formed along the opposite edges on the underside with the respective runners 82 and 84 having respective radii of curvature of which facilitate foot movement preferred by the athlete as the shoe is rolled from one side to the other during the grinding maneuver.

I have determined that during conventional grinding maneuvers, the wearer's foot is typically manipulated through a certain variation of foot orientations resulting in the grinding plate being maneuvered through certain typical patterns which results in loading of the underside of such plate. As an example, the human anatomy dictates that when the knee is rolled outwardly in a lateral direction, the foot tends to pivot essentially about a center of curvature located at the lateral outside of the foot. On the other hand, when the knee is rolled inwardly and forwardly, the flexibility in the foot cooperates with the hip joint, knee and raised medial arch to allow greater flexibility and freedom in the inward rolling of the foot. Thus, I have discovered that performance of the grind plate can be significantly enhanced by specially contouring the surface of the trough 31 to accommodate the differences in foot actuation for inward and outward rolling of the knee. To this end, I have constructed the apex of the trough bearing surface 31 to project along an axis in a generally horizontal axis under the majority of the transverse direction and then curve at the lateral extent upwardly and outwardly gradually along the contour of the lateral runner 84 (FIG. 9) and curve the medial side upwardly more abruptly to form the medial runner 82.

Referring to FIGS. 1 and 9, in the preferred embodiment the grind plate is approximately 10 centimeters wide at the front end and the side flange 83 angles rearwardly and inwardly in somewhat of a curved fashion to a 9 centimeter width at the rear end over a length of 9.5 centimeters. The body of the plate in the medial portion is 1.1 centimeters thick and the flanges 81 and 83 have an overall outside height along their major length of 1.3 centimeters from the extended trough bearing surface 31.

For ease of understanding, I will describe the configuration of the transverse axis at the apex of the trough, it being appreciated that such trough is, in practice cylindrically shaped. The trough at such apex projects for the majority of its traverse length, for a distance of about 7 centimeters along a substantially horizontal, bearing under the central part of the shoe and then turns upwardly in curved fashion at the opposite axis disposed transverse extremities. In the preferred embodiment I have curved the bearing surface upwardly and outwardly at the medial side at a radius of curvature of about 7 millimeters to form the medial runner 82 and curved the bearing surface upwardly and outwardly on the lateral side at a radius of curvature of 2.2 centimeters to form the lateral runner 84. It will be appreciated by those skilled in the art that such runners serve to accommodate different patterns of shoe manipulation and thus different foot manipulation on the underlying support rail surface for medial and lateral rolling of the athlete's knee. It is not critical that such runners have transverse curvatures defining an exact cylindrical configuration, it only being important that the trough bearing surface be flared upwardly and outwardly along about the lateral outermost 2 centimeters of the plate and along about the last 0.7 centimeters of the medial inner extent of the plate.

The groove 41 is about 2 centimeters wide throughout the majority of the length and expands centrally to about 2.5 centimeters in the area of the parallelogram shaped hole 39. The plate may be constructed of various different rigid low coefficient of friction materials such as metal, rubber, glass, ceramics and polyethylene composites. In the preferred embodiment, it is constructed of SUPERTUF® 801 nylon available from DuPont but other materials such as nylon 6 and PTEX® have been found to be acceptable. It will be noted that this groove 41 defining the unloaded area projects rearwardly and laterally at an angle of about 15° to the longitudinal center line of the plate and thus the longitudinal center line of the shoe sole 27. Thus, I discovered that the groove 41 may be formed between the bearing surfaces 33 and 35 to thus remove a substantial amount of the plate mass without significantly detracting from the performance of the plate itself. Additionally, I have discovered in the central area of the plate, the groove may be extended up and to the body of the grinding plate so far as to totally remove the body material thus leaving a vertically through hole 39, again without detracting from the performance of the plate.

In one embodiment of my plate, I provide a textured trough surface which is roughened to provide better gripping of the under support surface to thereby facilitate control by the athlete as he or she maneuvers along the surface of the underlying rail.

As is set forth more in greater detail in U.S. patent application Ser. No. 08/890,595 filed Jul. 9, 1997, now U.S. Pat. No. 6,006,451 it is beneficial to construct the grind plate body 21 so that it may be recessed upwardly into the bottom of the midsole 27 to such a degree that the lower extent of such grind plate is elevated above the horizontal plane to the lower most surface of forefoot outersole 45 and heel 43 so that during walking activity the grind plate will not typically contact the sidewalk or other horizontal support surface thus removing the irritating clunking sounds often associated with hard material mounted on the underside of a shoe. Additionally, it is desirable that the shoe sole 27 be constructed in such a manner so that it can flex to accommodate the typical flexures associated with typical walking or running orientations of the human foot. To this end, I have configured my grind plate body 21 with on the rearward side an anchor ear 91 (FIG. 10) formed with a through bore 93 for receipt of a fastener screw 95 configured to be received upwardly through the bore 57 in the sole 27 to be screwably received into the barrel 63 of the shank 65. The grind plate body 21 is formed on its forward extremity with a pair of flanking fastener ears 101 and 103 which are configured with respective longitudinal grooves 107 and 109 aligned underneath the forward bores 55 and 57 in the sole 27 for receipt of a respective shoulder bolt fasteners 111 and 113 which screw into the respective forward barrels 61 of the shank 65. This then serves to securely anchor the back of the plate body 21 at the front of the heel 43 and to floatingly anchor the front extremity of the plate to the midsole 27 via the forward barrel 61 of the shank 65. The shoulder bolts 111 and 113 serve to provide for tightening of the fasteners while leaving some looseness for the respective ears 107 and 109 so that the shoe sole will be free to flex to a certain degree relative to the grind plate and thus relative to the rear anchor fastener 95 to allow for flexure of the sole 27 relative the grind plate to thus provide for a more natural gait during walking and running activities.

It will be appreciated that the grind plate of the present invention may be fastened to a wearer's shoe or, for the saddle shaped plate shown in FIG. 1, may be nested upwardly into the concavity 25 of the midsole 27 shown in FIG. 10. Fastening to the shoe may be by straps, screws, bolts or the like. In preferred embodiment, it will be noted that I have selected the threaded fasteners 95, 111 and 113 which are screwed intermedially into threaded barrels 61 and 63 of the shank 65. In other embodiments of my invention, the fasteners in the form of screws or the like are screwed directly into a hard or soft soled shoe.

In the preferred embodiment, the shoe is configured with a midsole 27 having the concavity 25 formed therein to be complementally fitted by the top side of the grind plate body 21. Indentations are formed for the respective ears 91, 101 and 103. The grind plate may be installed at the factory or may be sold separate from the shoe in the aftermarket. In any event, when the fasteners 95, 111 and 113 are inserted and screwed into position the grinding plate body 21 is drawn upwardly into the concavity 25 to such a degree that the lower most extent of the grinding plate is elevated above the horizontal plane through the bottom tread of the heel 43 and forefoot outersole 45. In this manner, the wearer will be free to walk or run in the shoe in a normal manner and the longitudinal grooves 107, 109 (FIG. 10) will provide for a certain degree of lost motion for relative movement between the midsole and the forward extremity of the grind plate body 21.

When a wearer encounters an inviting grind surface, such as a rail or elongated curb, he or she can take a running start and leap onto the curb or rail and slide the shoe midsole 27 therealong in a laterally disposed position to engage the elongated rail or curb under the trough 21 to, under the influence of gravity, center the grind plate at its uppermost axis over such rail or curb. As the wearer maneuvers about, as by bending the knee inwardly and forwardly to rolling the shoe over on the medial side, the medial runner 82 will accommodate the maneuver and carry the weight of the wearer as applied thereto. I have discovered that the 7 millimeters radius of curvature in the medial arch area serves to accommodate this maneuver in allowing the athlete to achieve the degree of performance sought. As will be appreciated by those skilled in the art, the kinetics of the inward and forward rolling of the knee allows the plate, and thus the shoe, to roll over onto runner 82 to itself rotate through a radius of 7 millimeters. When the wearer then rocks the shoe back to a erect position directly over the rail, curb or the like, one or more of the bearing surfaces 33 or 35 can engage such rail carrying so much weight as the wearer applies to that particular grind plate. In the erect position, the athlete's weight and momentum will be carried by the lateral generally horizontal, medial bearing surface along a width direction of about 7 centimeters thus affording good stability. As the wearer continues along and possibly exercises a maneuver bringing the shoe up to an inclined orientation rolling over on the lateral side, the weight applied to the grind plate will be carried by the rounded surface of the lateral runner 84 allowing for extreme lateral knee bend. All this takes place in a relatively smooth manner due, in large extent, to the relatively large radius' of radii of curvature for the runner 84. In this regard, it will be appreciated that the lower lateral foot arch, knee and hip joints cooperate with the 2.2 centimeter radius of curvature to thus allow the foot to rotate laterally outwardly about a center of curvature located almost in the vertical horizontal plane of the transverse center of the foot. This provides for efficient high performance for a young adult athlete wearing a shoe from about 7–10 in size. As will be apparent to those skilled in the art, the ratios of dimensions could be changed for smaller or larger shoes sized to establish the proportionate contour for the same high performance.

Throughout this maneuvering activity it will be appreciated that the performance of the grinder is relatively unaffected by the fact that bearing surface is absent from throughout the area of groove 41 from the front to the back of the plate. Thus the wearer has the benefit of full support throughout the medial to the lateral side of the shoe and even up along the opposite edges as dictated by the flanges 81 and 83 all without being burdened by the weight of material which would otherwise exist in the area of the groove 41 and opening 39.

From the foregoing it will be appreciated that the grinding plate of the present invention provides a economical and convenient device for undertaking an athletic grinding maneuver utilizing a relatively light weight grinding plate which will possess all the performance characteristics associated with full bearing surface grinding plates but without the attendant weight.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A shoe grind plate for mounting under the arch in a shoe sole comprising:

an arcuate plate configured with a transversely projecting arcuate trough having a central bearing surface projecting transversely over at least a portion of said trough and including a central bearing axis configured at the lateral extremity to curve outwardly and upwardly and form a longitudinally projecting lateral runner having a first radius of curvature and further being formed at its medial extremity to curve outwardly and upwardly to define a longitudinally projecting medial runner having a second radius of curvature smaller than said first radius of curvature.

2. A shoe grind plate of claim 1, wherein:

said first radius of curvature is substantially 2.2 centimeters.

3. A shoe grind plate of claim 1, wherein:

said second radius of curvature is substantially 7 millimeters.

4. A shoe grind plate of claim 1, wherein:

said runners are spaced transversely about 7 centimeters apart.

5. A shoe grind plate of claim 1, wherein:

said plate is formed with a body substantially 1.1 centimeters thick.

6. A shoe grind plate of claim 1 wherein:

said trough is configured in the form of a sector of a cylinder having a diameter of substantially 4 centimeters.

7. A shoe grind plate of claim 1, wherein:

said plate is formed with a body having a front extremity substantially 10 centimeters wide.

8. A shoe grind plate of claim 1, wherein:

said plate is formed between said runners with a recess raised upwardly from said bearing surface.

9. A shoe grind plate of claim 1, wherein:

said plate is formed on the forward and rearward extremities with through fastener openings for receipt of threaded fasteners.

10. A shoe grind plate of claim 2, that includes:

a shank for mounting on said sole and including threaded bores for receipt of said threaded fasteners.

11. A shoe grind plate of claim 1, wherein:

said lateral and medial runners curve outwardly and upwardly to form 2.2 and 0.7 centimeters radii of curvature respectively.

12. A shoe grind plate of claim 11, wherein:

said trough is formed with said bearing surface projecting laterally a distance of substantially 7 centimeters between said runners.

13. A shoe grind plate of claim 1, wherein:

said plate is configured with flanking cylindrical sectors formed with downwardly facing transversely spaced apart bearing surfaces separated by a longitudinally projecting downwardly opening groove.

14. A shoe grind plate of claim 13, wherein:

said plate is formed medially in said groove with a through lightening opening.

15. Grind shoe apparatus comprising:

a shoe having a sole configured with a bottom surface and having a downwardly opening cavity of a predetermined configuration formed therein; and a rigid grind plate configured with a top surface to complement said predetermined configuration and formed with a downwardly facing laterally projecting raised trough having a downwardly facing arcuately shaped bearing face configured with flanking bearing surfaces separated by a centrally disposed longitudinal recess raised upwardly from said face.

16. Grind shoe apparatus as set forth in claim 15, wherein:

said plate is configured with said recess in, at least some area, extending through the thickness thereof.

17. Grind shoe apparatus as set forth in claim 15, wherein:

said recess projects longitudinally in said face.

18. Grind shoe apparatus as set forth in claim 15, wherein:

said recess angles rearwardly from the front of said plate toward the lateral side thereof.

19. Grind shoe apparatus as set forth in claim 15, wherein:

said plate is wedge shaped in plan view with the lateral edges thereof angling rearwardly and inwardly.

20. Grind shoe apparatus as set forth in claim 15, wherein:

said recess is generally parallelogramatically shaped in plan view.

21. Grind shoe apparatus as set forth in claim 15, wherein:

said plate is configured with said trough formed with a compound curvature to curve laterally and medially upwardly and outwardly.

22. Grind shoe apparatus as set forth in claim 15, wherein:

said plate is formed on its upper side with raised longitudinal flanges projecting along the opposite edges.

23. Grind shoe apparatus as set forth in claim 15, wherein:

said plate is configured to define said recess in the form of a groove extending substantially from the front of said plate to the rear thereof and is further formed with a through hole disposed centrally in said groove.

24. Grind plate apparatus as set forth in claim 18, wherein:

said recess angles rearwardly and laterally at an angle of substantially 15° to the longitudinal centerline of said plate.

25. Grind shoe apparatus as set forth in claim 18, wherein:

said recess is in the form of a groove having a semi-cylindrical cross section.

26. Grind shoe apparatus as set forth in claim 24, wherein:

said recess is further configured medially with a through hole.

27. Grind shoe apparatus as set forth in claim 15, that includes:

threaded fasteners for fastening said plate to said sole.

28. Grind shoe apparatus as set forth in claim 27, wherein:

said fasteners include respective studs formed with screw threads and end fittings formed with threaded bores for threadably engaging said screw threads.

29. A grind plate for mounting on the sole of a shoe and comprising:

a rigid plate formed with a downwardly facing laterally projecting raised trough having a downwardly facing arcuately shaped bearing face configured with flanking bearing surface segments separated by a centrally disposed longitudinal recess raised upwardly from said face.

30. Grind shoe apparatus as set forth in claim 15, that includes:

a lost motion fastener device connecting said plate to said sole and including longitudinal slots and interfitting fasteners slidable in said slots.

31. Grind shoe apparatus as set forth in claim 15, wherein:

said grind plate is formed with a cylindrical body having a thickness throughout a majority of its area of substantially 11 millimeters with said recess being formed therein.

32. Grind shoe apparatus as set forth in claim 15, wherein:

said plate is substantially 9.5 centimeters long.

33. Grind shoe apparatus as set forth in claim 15, wherein:

said recess is substantially 2 centimeters wide.

34. Grind shoe apparatus as set forth in claim 23, wherein:

said hole is parallelogram shaped and is substantially 2 centimeters on a side.

* * * * *